US008172452B2

(12) United States Patent
Bacon et al.

(10) Patent No.: US 8,172,452 B2
(45) Date of Patent: May 8, 2012

(54) LID WITH COLLAPSIBLE STIRRER

(75) Inventors: Derek Bacon, Hamden, CT (US); George Ballard, New Haven, CT (US); Richard Rodican, Orange, CT (US)

(73) Assignee: Stacked, LLC, Hamden, CT (US)

( * ) Notice: Subject to any disclaimer, the term of this patent is extended or adjusted under 35 U.S.C. 154(b) by 376 days.

(21) Appl. No.: 12/501,777

(22) Filed: Jul. 13, 2009

(65) Prior Publication Data

US 2010/0065566 A1 Mar. 18, 2010

Related U.S. Application Data

(60) Provisional application No. 61/097,631, filed on Sep. 17, 2008.

(51) Int. Cl.
*B01F 7/18* (2006.01)

(52) U.S. Cl. ..... 366/130; 366/244; 366/308

(58) Field of Classification Search ..... 366/130, 366/241–260, 279, 285–286, 308; 220/212; 99/348

See application file for complete search history.

(56) References Cited

U.S. PATENT DOCUMENTS

| | | | | |
|---|---|---|---|---|
| 1,163,982 | A | 12/1915 | Dore | |
| 1,926,655 | A | 9/1933 | Shaw | |
| 2,793,012 | A | 5/1957 | Wolf | |
| 3,894,723 | A | 7/1975 | Sanders et al. | |
| 4,359,283 | A | 11/1982 | McClellan | |
| 4,408,690 | A | 10/1983 | Ferrero | |
| 4,460,279 | A | 7/1984 | Krasney | |
| 4,893,940 | A | 1/1990 | Waisberg | |
| 5,251,774 | A * | 10/1993 | Engle | 220/212 |
| 5,251,979 | A | 10/1993 | Larsen | |
| 5,586,676 | A * | 12/1996 | Lynd | 220/212 |
| 6,071,006 | A | 6/2000 | Hochstein et al. | |
| 6,224,253 | B1 | 5/2001 | Dixon | |
| 6,371,324 | B1 | 4/2002 | Torniainen et al. | |
| 6,616,323 | B2 * | 9/2003 | McGill | 366/201 |
| 6,871,995 | B2 * | 3/2005 | Simba | 366/129 |
| 7,946,752 | B2 * | 5/2011 | Swartz et al. | 366/247 |
| 2003/0179647 | A1 * | 9/2003 | Simba | 366/276 |
| 2004/0090861 | A1 * | 5/2004 | Kitson | 366/244 |

(Continued)

FOREIGN PATENT DOCUMENTS

WO W02007/030533 3/2007

*Primary Examiner* — Charles E Cooley
(74) *Attorney, Agent, or Firm* — DeLio & Peterson, LLC; Thomas E. Ciesco

(57) ABSTRACT

A mixing lid attachable to a beverage container, comprising a lid base having an upper surface, a lower surface and a central opening extending between the upper and lower surfaces and a mixing assembly rotatable about the central opening of the lid base. The mixing assembly includes a rotary plate disposed on the upper surface of the lid base and a rotary arm disposed on the lower surface of the lid base and attached to the rotary plate through the central opening in the lid. The rotary arm lies substantially flat against the lower surface of the lid. The mixing assembly includes a pivot arm pivotably attached at a first end of the pivot arm to the rotary arm. The pivot arm is pivotable from a first position lying flat against the interior surface of the lid to a second downward position extending toward the bottom of the beverage container. The mixing assembly includes a mixing arm pivotably attached to a second end of the pivot arm opposite the first end of the pivot arm.

11 Claims, 11 Drawing Sheets

U.S. PATENT DOCUMENTS

2007/0291585 A1 12/2007 Sivers
2008/0080299 A1 4/2008 Takumah
2009/0147615 A1* 6/2009 Parias Cruz ..... 366/130
2009/0277902 A1* 11/2009 Darflinger ..... 220/212
2010/0014379 A1* 1/2010 Wright et al. ..... 366/308
2010/0065566 A1* 3/2010 Bacon et al. ..... 220/212

* cited by examiner

LID WITH COLLAPSIBLE STIRRER

This patent application is relates to U.S. Provisional Patent Application, Ser. No. 61/097,631, filed Sep. 17, 2008 for which applicants claim priority.

BACKGROUND OF THE INVENTION

1. Field of the Invention

The present invention relates generally to beverage containers and, in particular, beverage containers having a lid with an integrated stirring mechanism.

2. Description of Related Art

Beverage containers come in various forms. For example, cups or mugs commonly hold hot and cold beverages such as, for example, coffee, tea, chocolate drinks, juice drinks, energy drinks, soup, and the like. Often, drinkers prefer to add ingredients to these beverages such as, for example, cream or milk based products, sugar, honey or other sweeteners, and the like. A spoon, stick or other stirring device is typically used to mix the ingredients into the beverage. With beverages taken "to-go," a lid is often attached to the container to prevent inadvertent spillage. As undissolved or insoluble ingredients settle on a bottom surface of the beverage container, it may be desirable to again stir the beverage. When a stirring stick or spoon is not available, a drinker may mildly shake the cup or mug to mix the ingredients. When the stirring stick or spoon is supplied and used to stir the beverage, germs, bacteria or viruses may be deposited into the beverage. This is often the case since a cluster of stirrers are usually supplied in a container accessed by many coffee drinkers and are exposed to unsanitary habits of the users. Also, with hot beverages, stirring and shaking the beverage container may raise safety concerns as hot liquid may spill out of the container and injure the drinker. With cold beverages, spillage may be more of an inconvenience as the spillage may stain the drinker and/or their clothes or other belongings.

As can be appreciated, if the beverage container includes a lid, the lid is typically not attached when the beverage is mixed. As noted above, mixing or shaking without the lid may raise safety or convenience concerns.

SUMMARY OF THE INVENTION

Bearing in mind the problems and deficiencies of the prior art, it is therefore an object of the present invention to provide a new and improved beverage container lid.

It is another object of the present invention to provide a collapsible extendable stirrer integrated in a lid for the beverage container.

A further object of the invention is to provide a lid for stirring a beverage in beverage containers of various sizes.

It is yet another object of the present invention to provide a disposable coffee lid having a collapsible stirrer.

Still other objects and advantages of the invention will in part be obvious and will in part be apparent from the specification.

The above and other objects, which will be apparent to those skilled in the art, are achieved in the present invention which is directed to a mixing lid attachable to a beverage container, comprising a lid base having an upper surface, a lower surface and a central opening extending between the upper and lower surfaces and a mixing assembly rotatable about the central opening of the lid base. The mixing assembly includes a rotary plate disposed on the upper surface of the lid base and a rotary arm disposed on the lower surface of the lid base and attached to the rotary plate through the central opening in the lid. The rotary arm lies substantially flat against the lower surface of the lid. The mixing assembly includes a pivot arm pivotably attached at a first end of the pivot arm to the rotary arm. The pivot arm is pivotable from a first position lying flat against the interior surface of the lid to a second downward position extending toward the bottom of the beverage container. The mixing assembly includes a mixing arm pivotably attached to a second end of the pivot arm opposite the first end of the pivot arm.

In a preferred embodiment, the mixing arm comprises a plurality of elongated mixing members each slidably attached along an adjacent mixing member. The mixing arm may be pivotable from a first position lying flat against the interior surface of the lid in the collapsed position to a second downward position extending toward the bottom of the beverage container and in the extended position. The mixing arm may include at least one mixing member extendable to the bottom of the beverage container.

The mixing lid may include a second opening near an edge of the lid for removing the beverage in the beverage container. The mixing assembly may be foldable for positioning between a first stowed position and a second released position. In the stowed position, the mixing assembly lies substantially flat against an inner surface of the lid. In the released position the mixing arm extends to the bottom of the beverage container.

The mixing lid may include an annular lip for sealably attaching the lid to the beverage container. The rotary plate may include a receptacle adapted to accept a finger or object for producing a rotational force on the rotary plate.

The mixing lid may include a fixed tab disposed near the lower surface of the lid positioned to hold the second rotary arm and the telescoping mixing against the lid lower surface when the mixing assembly is in a first position and to release the second rotary arm and the telescoping mixing arm when the mixing assembly is rotated away from the first position. The mixing assembly may include a hub or rotary connector disposed in the central opening connecting the rotary plate to the rotary arm.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-22 of the drawings in which like numerals refer to like features of the invention.

Figure 2:
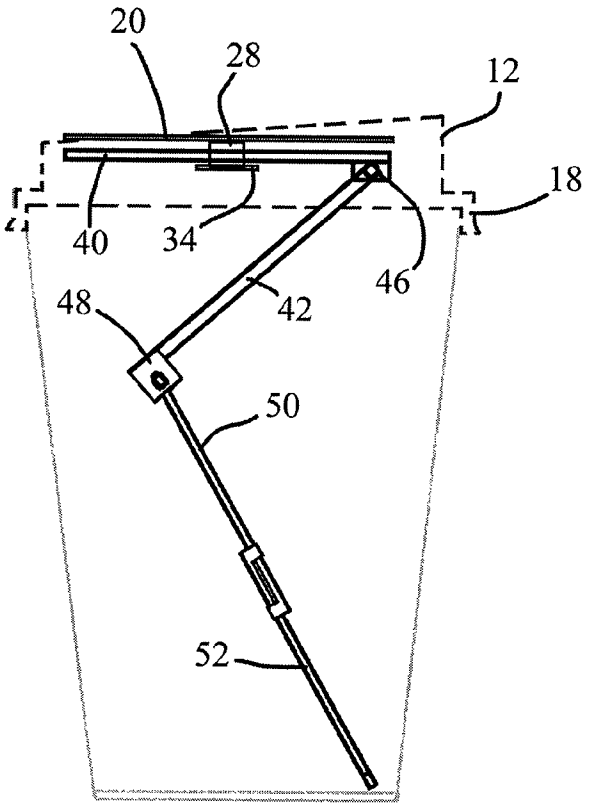
FIG. 2 is a side elevational view of the Lid with Collapsible Stirrer shown in FIG. 1.
Figure 1:
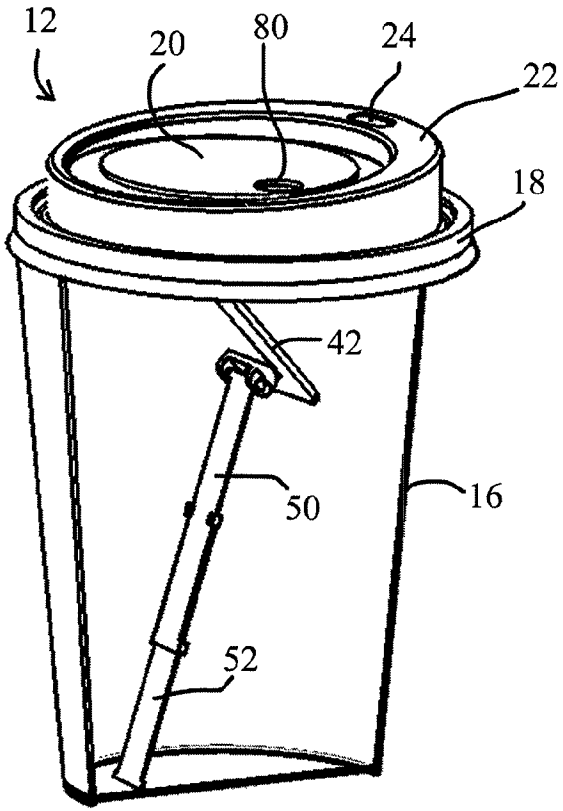
FIG. 1 is a side perspective view of the Lid with Collapsible Stirrer attached to a beverage cup shown in a cutaway view according to the present invention.
Figure 3:
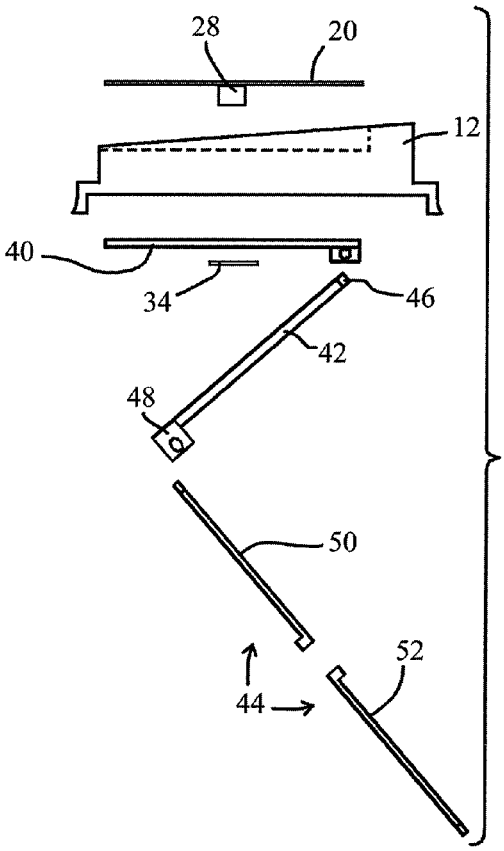
FIG. 3 is an exploded side view of the Lid with Collapsible Stirrer shown in FIG. 1.
Figure 3A:
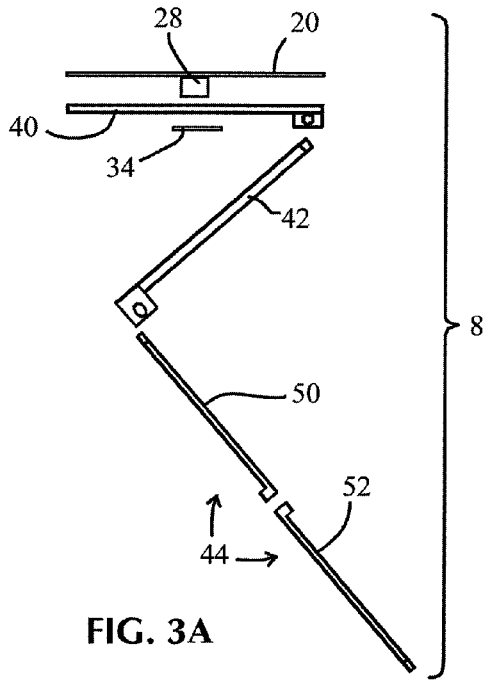
FIG. 3A is an exploded view of the mixing assembly according to the present invention.
Figure 4:
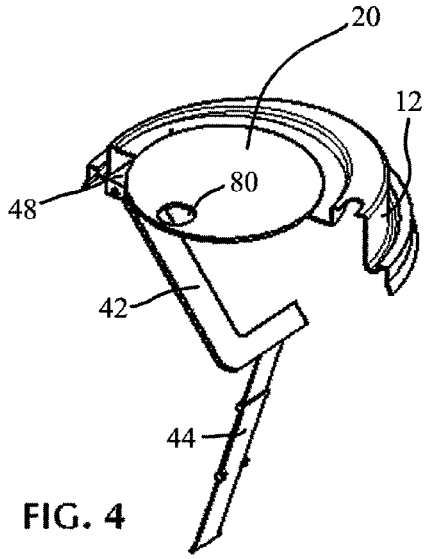
FIG. 4 is a top perspective view of the Lid with Collapsible Stirrer with a cut-away of the lid base.
Figure 5:
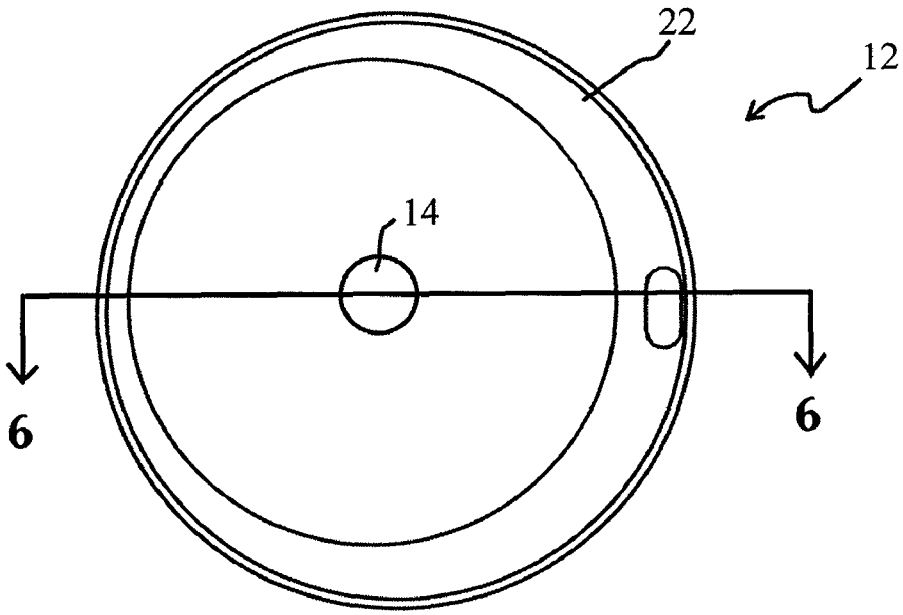
FIG. 5 is a top plan view of the lid base of the Lid with Collapsible Stirrer according to the present invention.
Figure 6:
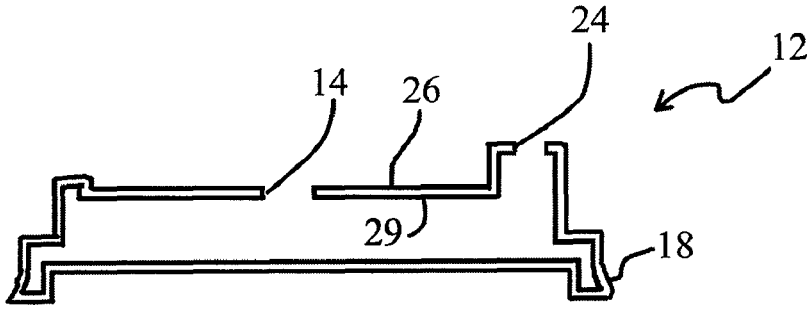
FIG. 6 is a side elevational view of the lid base viewed from the cut line 6-6 shown in FIG. 5.
Figure 7:
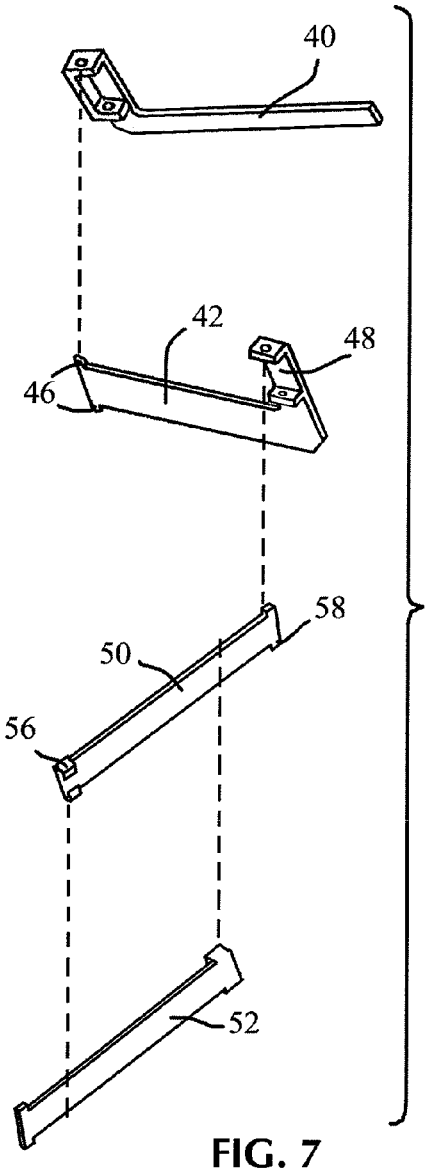
FIG. 7 is an exploded perspective view of the mixing assembly according to the present invention.
Figure 8A:
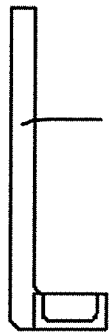
FIG. 8A is a bottom view of the rotary arm in a first position lying flat against the interior surface of the lid according to the present invention.
Figure 8B:
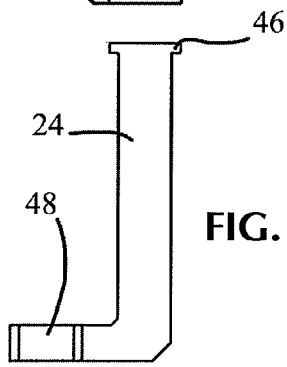
FIG. 8B is a bottom view of the pivot arm in a first position lying flat against the interior surface of the lid according to the present invention.
Figure 8C:
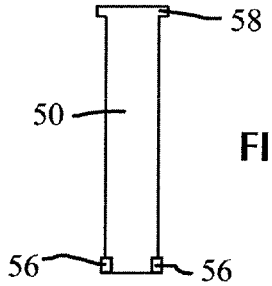
FIG. 8C is a bottom view of the first mixing member in a first position lying flat against the interior surface of the lid according to the present invention.
Figure 8D:
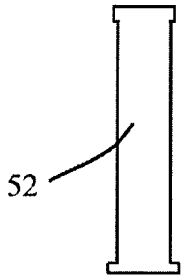
FIG. 8D is a bottom view of the second mixing member in a first position lying flat against the interior surface of the lid according to the present invention.

The lid with collapsible stirrer, also referred to as a mixing lid 10, includes a lid base 12 and a mixing assembly 8. FIGS. 1-4 show various views of the mixing lid according to the present invention. FIG. 3B shows the mixing assembly 8. The mixing assembly 8 is rotatably attached to the lid base 12 attachable to a beverage container 16, preferably a cup for coffee or other beverage. The lid base 12 shown in the top and bottom views of FIGS. 5 and 6 has an upper surface 26, a lower surface 29 and a central opening 14 which extends between the upper and lower surfaces. The mixing assembly 8 is rotatable about the central opening 14 of the lid base, and includes a rotary plate 20 disposed on the upper surface 26 of the lid base 12 and a rotary arm 40 disposed on the lower surface 29 of the lid base 12. The rotary arm 40 is attached to the rotary plate 20 through the central opening 14 in the lid, the rotary arm lying substantially flat against the lower surface of lid. A rotary connector 28 may be used to connect the rotary plate 20 to the rotary arm 40. The lower section of the mixing assembly shown in FIGS. 7 and 8 includes a pivot arm 42 pivotably attached at a first end 46 of the pivot arm to the rotary arm 40, the pivot arm 42 pivotable from a first position lying flat against the interior surface of the lid to a second downward position extending toward the bottom of the beverage container. A mixing arm 44 is pivotably attached to a second end 48 of the pivot arm 42 opposite the first end of the pivot arm. The mixing arm includes a plurality of mixing members 50, 52 each slidably attached along an adjacent mixing member. The mixing arm 44 is pivotable from a first position lying flat against the interior surface of the lid in the collapsed position to a second downward position extending toward the bottom of the beverage container and in the extended position. The mixing members include a folded tab 56 on one end and a straight tab 58 on the opposite end. The mixing member 50, 52 are adapted to slidingly attach to an adjacent mixing member by the folded tab 56. The straight tab 58 prevents the mixing members 50,52 from sliding completely apart. The mixing arm 44 may include any number of mixing members and is adapted to extend to the bottom of the beverage cup 16 upon deployment or release from the folded position.

The rotary plate 20 includes a receptacle 80 for insertion of a finger or elongated object for facilitating rotation of the plate. The receptacle may be an indent, recess or an opening extending through the rotary plate.

The mixing assembly 8 may include a stow tab 34 adapted to hold the pivot arm 42 and mixing arm 44 flat against the bottom surface 29 of the lid base 12 until the rotary plate is rotated from an initial position to a position sufficient to release the pivot arm 42 and mixing arm 44.

Figure 9:
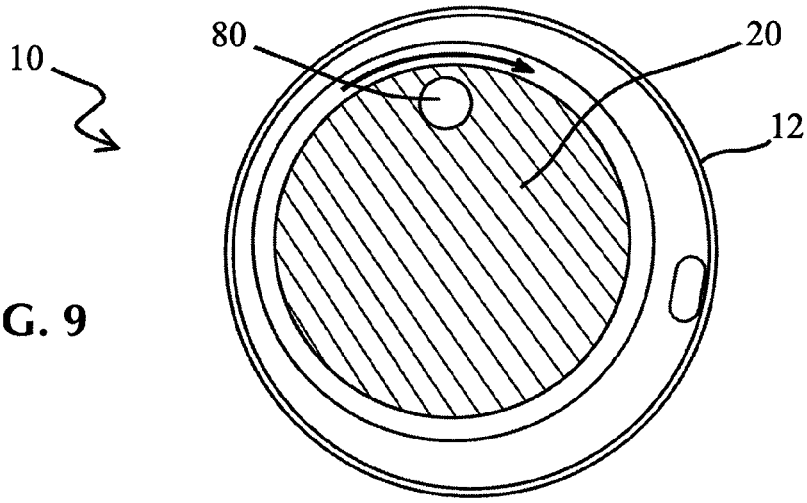
FIG. 9 is a top plan view of the Lid with Collapsible Stirrer shown in FIG. 1.
Figure 10:
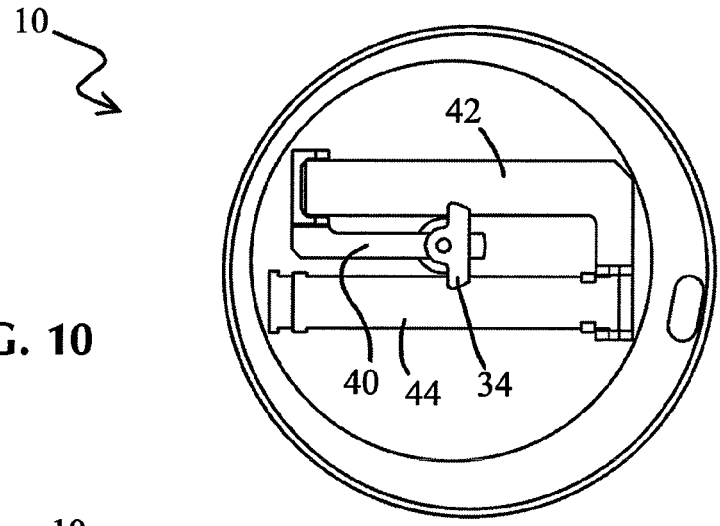
FIG. 10 is a bottom view of the Lid with Collapsible Stirrer showing the rotary arm and mixing arm restrained by the fixed tab on the lid base.
Figure 11:
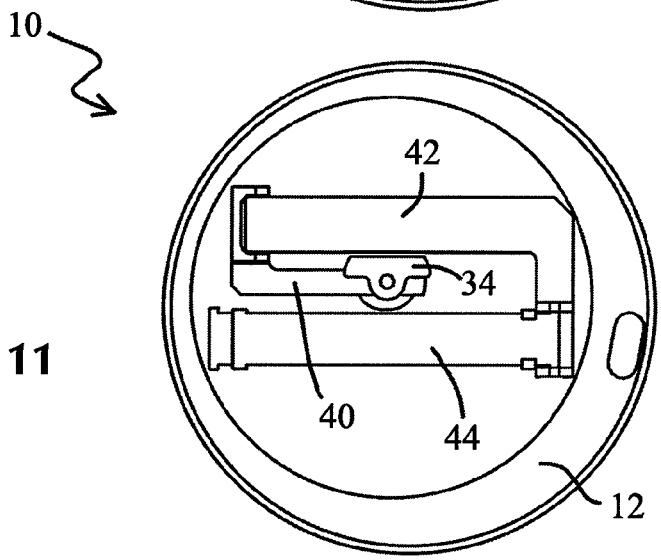
FIG. 11 is a bottom view of the Lid with collapsible stirrer with the mixing assembly in the initial release position according to the present invention.
Figure 13:
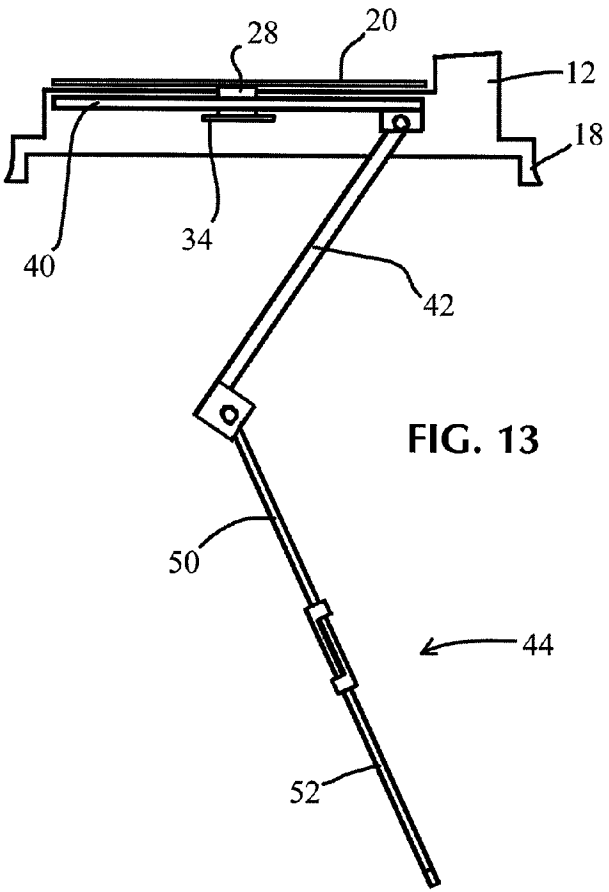
FIG. 13 is a cross-sectional side view of the lid with collapsible stirrer after complete release of the pivot arm and mixing arm.
Figure 12:
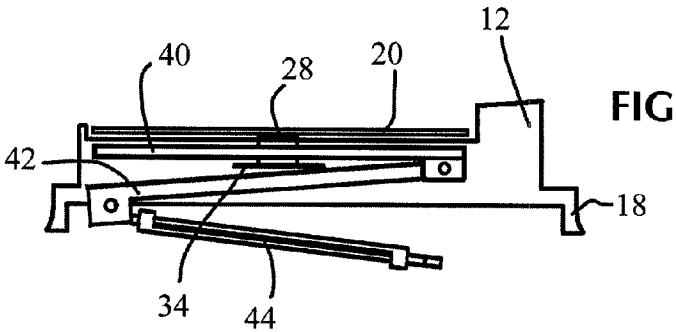
FIG. 12 is a cross-sectional side view of the Lid with Collapsible Stirrer after initial release of the pivot arm and mixing arm according to the present invention.
Figure 14:
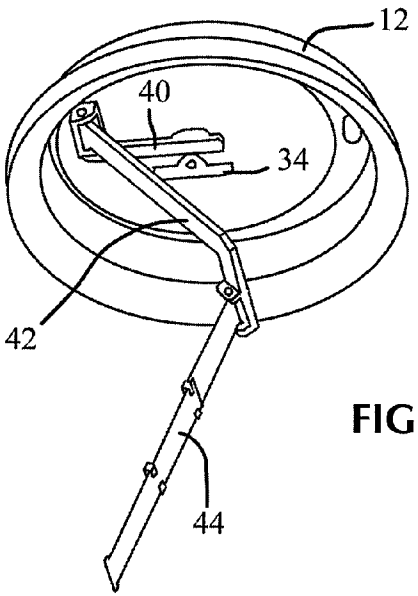
FIG. 14 is a bottom perspective view of the Lid with Collapsible Stirrer showing rotation of the mixing assembly according to the present invention.

FIGS. 9-11 show the lid release mechanism in a top view showing rotation of the rotary plate, bottom view showing the pivot arm 42 and mixing arm 44 in the stowed position, and bottom view after the rotary plate 20 has been rotated sufficient to release the pivot arm 42 and the mixing arm 44. FIGS. 12 and 13 respectively show the pivot arm and mixing arm after the initial release and after complete release. FIG. 14 shows a bottom perspective view of the mixing lid 10 of FIG. 13.

Figure 15A:
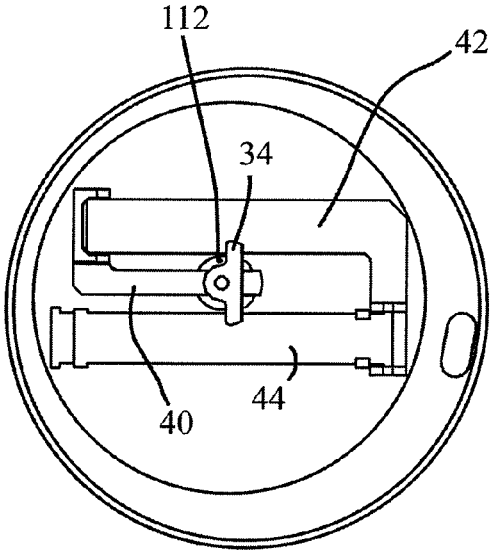
FIG. 15A is a bottom view of an first alternate release mechanism in a stowed position according to the present invention.
Figure 15B:
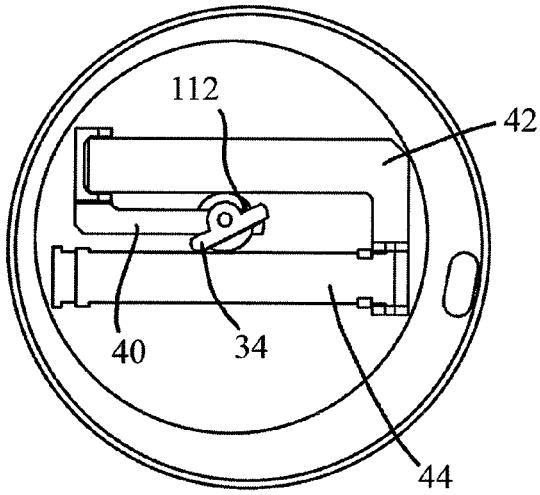
FIG. 15B is a bottom view of an first alternate release mechanism in a release position according to the present invention.
Figure 15C:
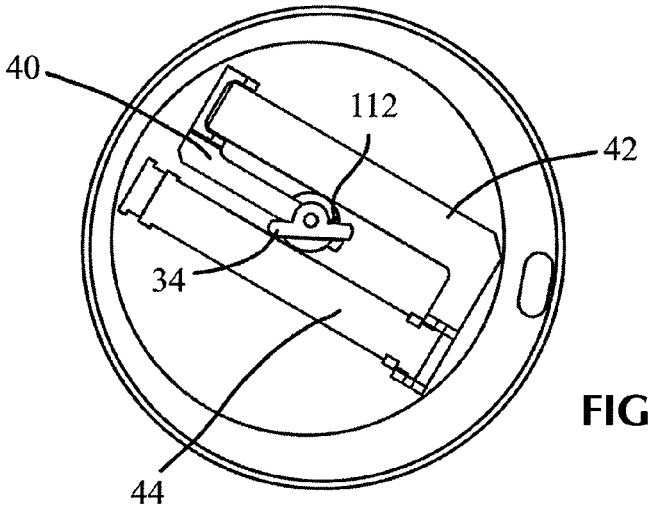
FIG. 15C is a bottom view of an first alternate release mechanism in a stir position according to the present invention.

In an alternate embodiment of the release mechanism, FIGS. 15A-15C a pin 112 protruding from a lower surface of the rotary connector 28 lies near or against an edge of the tab 34, the tab independently rotatable about the central opening. The rotary arm lies substantially flat against the lower surface of the lid base and extends outward from the central opening central axis such that a portion of an edge of the rotary arm is in the rotational path of the pin.

In operation, FIG. 15A shows the release mechanism in a stowed position. The pin 112 lies near or against an edge of the tab, the tab contacting and restraining at least a portion of the pivot arm 42 and the mixing arm 44. The mixing arm 44 is in a shortened position whereby the mixing members substantially overlap. As the rotary plate 20 rotates the rotary connector, the pin 112 lying against or near the tab urges the tab from the restraining position to the release position as shown in FIG. 15B. The pivot arm 42 and the mixing arm 44 extend toward the bottom of the beverage container. For clarity purposes, since the figures are included for showing the detail of the release mechanism, the pivot arm and mixing arm are shown flat against the lower surface of the lid in FIGS. 15B and 15C even though the pivot arm and mixing arm would be in a partial or fully extended position. Continued rotation of the rotary plate urges the pin 112 against an edge of the rotary arm 40 shown in FIG. 15C and subsequent rotation of the rotary arm. Rotation is imparted to the pivot arm 42 and mixing arm 44 in a rotational direction.

Figure 16A:
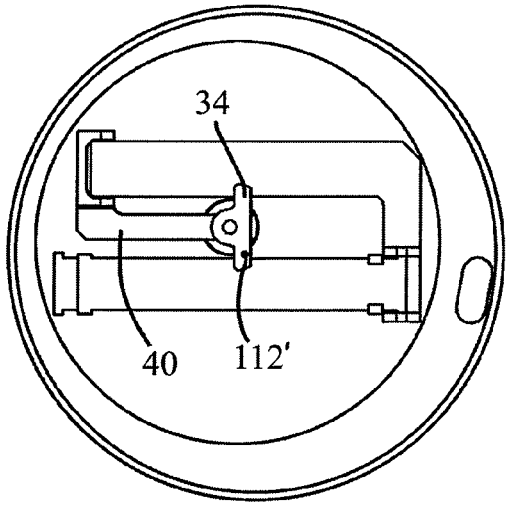
FIG. 16A is a bottom view of a second alternate release mechanism in a stowed position according to the present invention.
Figure 16B:
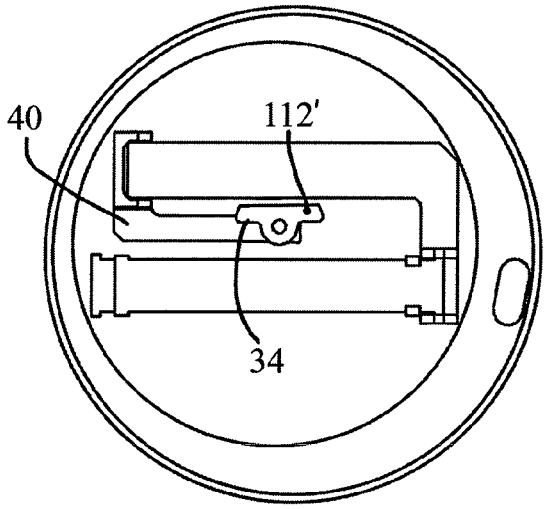
FIG. 16B is a bottom view of a second alternate release mechanism in a release position according to the present invention.
Figure 16C:
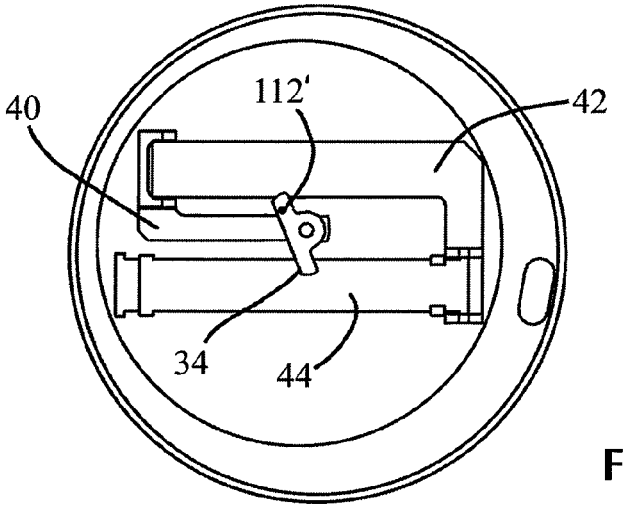
FIG. 16C is a bottom view of a second alternate release mechanism in a stir position according to the present invention.

In another embodiment of the release mechanism shown in FIGS. 16A-16C, a pin 112' protrudes from the tab 34. The tab is connected to the rotary connector and is rotated by rotation of the rotary plate 20. An edge of the rotary arm 40 is in the rotational path of the pin.

In operation, FIG. 16A shows the release mechanism in a stowed position. The tab contacts and restrains at least a portion of the pivot arm 42 and the mixing arm 44. The mixing arm 44 is in a shortened position. As the rotary plate 20 rotates the rotary connector, the tab 34 rotates from the restraining position to the release position as shown in FIG. 16B. The pivot arm 42 and the mixing arm 44 extend toward the bottom of the beverage container. Continued rotation of the rotary plate urges the pin 112' against the edge of the rotary arm 40 shown in FIG. 16C. Further rotation of the rotary plate imparts the rotational force to the pivot arm 42 and mixing arm 44.

Figure 17A:
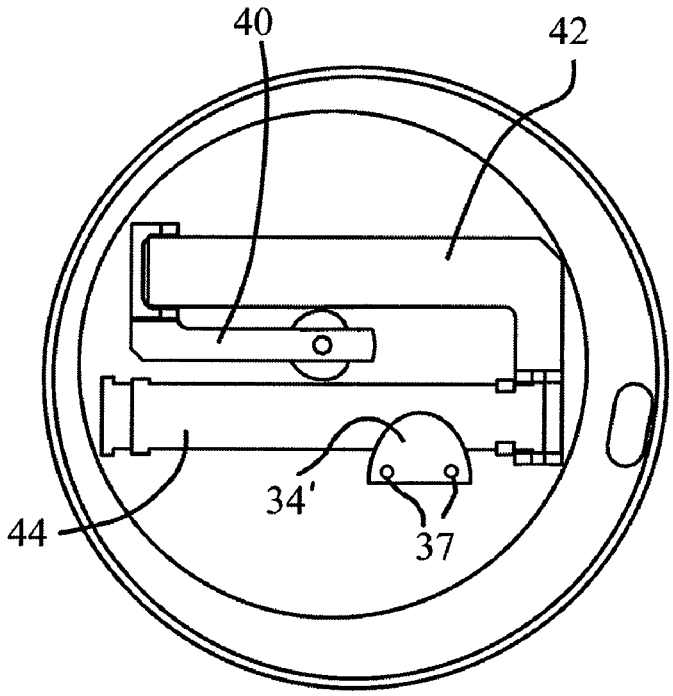
FIG. 17A is a bottom view of a third alternate release mechanism in a stowed position according to the present invention.

In another embodiment of the release mechanism, a tab 34' is attached along or near at least one edge 35 to the lower surface of the lid base. The mixing arm is slidingly disposed between a loose end of the tab opposite the attached edge 35 as shown in FIG. 17A. The rotary arm 40 is attached to the rotary plate 20 through the rotary connector 28. The tab may be thermally fused to the lower surface of the lid or the tab may include press fit protuberances 37 which lock together with corresponding protuberances 39 on the lower surface of the lid shown in a cutaway of the tab 34' in FIG. 17B.

Figure 17B:
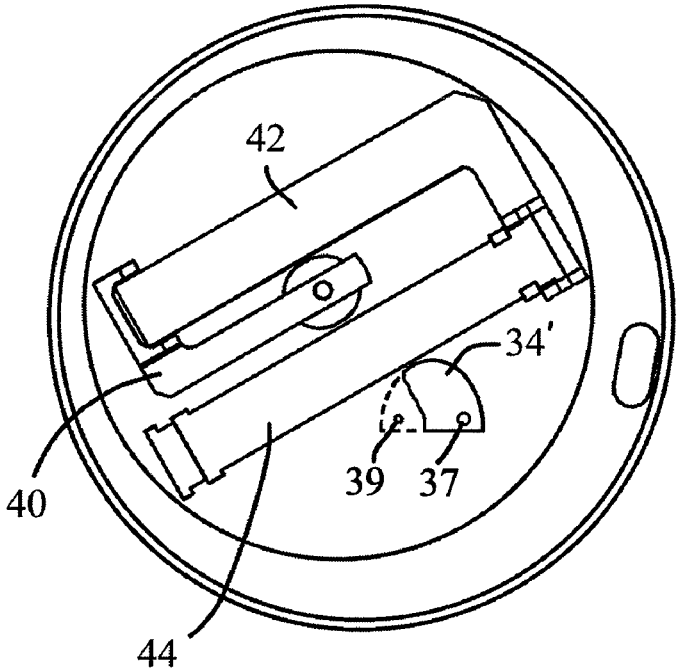
FIG. 17B is a bottom view of a third alternate release mechanism in a release position according to the present invention.

In operation, rotation of the rotary plate rotates the pivot arm and the mixing arm until the mixing arm slides out from between the tab 34' and the lower surface of the lid base as shown in FIG. 17B.

Another aspect of the present invention is a method of using a lid with collapsible stirrer. Referring back to FIGS. 1 and 2, the method includes providing a lid base 12, a mixing assembly 8 rotatably attached to the lid base 12. The lid base 12 has an upper surface 26, a lower surface 29 and a central opening 14. The mixing assembly 8 includes a rotary plate 20 disposed on the upper surface 26 of the lid base 12, a rotary arm 40 disposed on the lower surface 29 of the lid base 12 and attached to the rotary plate 20 through the central opening 14 in the lid. Initially, the rotary arm lies substantially flat against the lower surface of lid. The mixing assembly includes a pivot arm 42 pivotably attached at a first end 46 of the pivot arm to the rotary arm 40, the pivot arm 42 pivotable from a first position lying flat against the interior surface of the lid to a second downward position extending toward the bottom of the beverage container. The method includes providing a mixing arm 44 pivotably attached to a second end 48 of the pivot arm 42 opposite the first end of the pivot arm. The mixing arm includes a plurality of mixing members 50, 52 each slidably attached along an adjacent mixing member. The mixing arm 44 is pivotable from a first position lying flat against the interior surface of the lid in the collapsed position to a second downward position extending toward the bottom of the beverage container and in the extended position. The mixing arm 44 may include any number of mixing members and is adapted to extend to the bottom of the beverage cup 16 upon deployment or release from the folded position.

The method includes attaching the mixing lid 10 to the top of a beverage cup containing a beverage. A finger or elongated object is placed in the receptacle and a force is applied to rotate the plate 20. Initial rotation of the rotary plate 20 releases the pivot arm and mixing arm by rotating the stow tab from a locking position in FIG. 10 to the releasing position in FIG. 11. Subsequent rotation of the rotary plate 20 urges rotation of the rotary arm 40, pivot arm 42 and mixing arm 44 during and after release of the pivot arm 42 and mixing arm 44.

Figure 18:
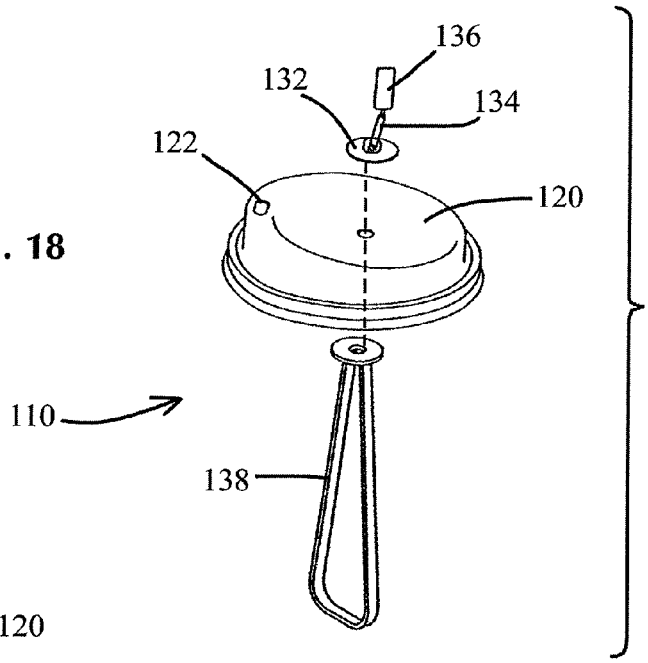
FIG. 18 is exploded perspective view of a second embodiment of the collapsible stirrer according to the present invention.
Figure 19:
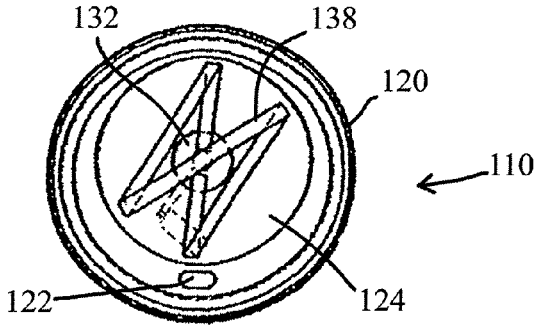
FIG. 19 is a bottom view of the second embodiment of the collapsible stirrer shown in FIG. 15, with the mixer in a collapsed position.

In another aspect of the present invention, illustrated in FIGS. 18 and 19, a mixing lid assembly 110 is depicted. As illustrated in an exploded assembly view of FIG. 18, the mixing lid assembly 110 includes a lid 120 such as, for example, a thermoformed disposable cup lid, having a drinking aperture 122, and a releasable mixing device 130 coupled thereto. The mixing lid 110 includes a rotary connector 132 rotatably coupled to the lid 120, a rotary connector arm 134, turn handle 136 coupled to the rotary connector 132 and a mixer 138 coupled to rotary connector 132. In operation, the rotary connector arm 134 and the pivot handle 136 are rotated (e.g., in at least one of a clockwise and counterclockwise direction) to turn the rotary connector 132 and, in effect, to turn the mixer 138 in a corresponding clockwise or counterclockwise direction. In one embodiment, the rotary connector 132 rotates in an about 360° range of motion. When affixed to a beverage container such as beverage container, the rotational motion is sufficient for stirring or mixing the contents of the beverage container such as, for example, coffee, tea, juice or other beverage, and any ingredients added therein.

As shown in FIGS. 18 and 19, the mixer 138 is selectively disposed between one of a released position (FIG. 18) and a stowed position (FIG. 19). In the released position, the mixer 138 extends within a depth of the beverage container and operates, as described above, such that as the rotary connector arm 134 and the pivot handle 136 are rotated, the rotary connector 132 and the mixer 138 are rotated. In the stowed position, the mixer 138 is folded to lay substantially flat against an inner surface 124 of the lid 120. In one embodiment, the pivot handle 136 is folded to lay substantially flat against an upper surface of the lid 120. It should be appreciated that in the stowed position, two or more of the mixing lid assemblies 110 may be stacked such as, for example, during storage or shipment.

Figure 20:
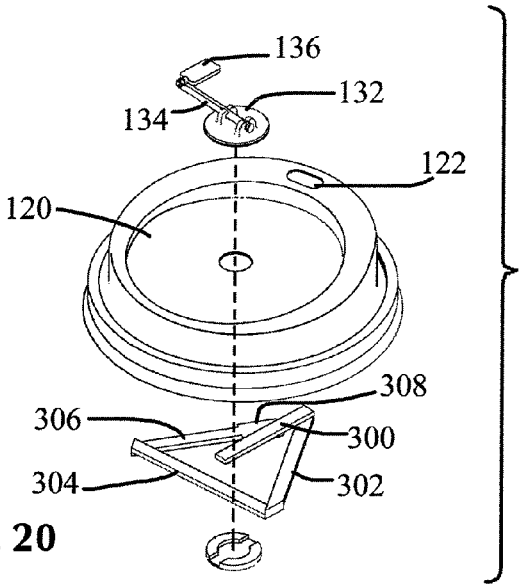
FIG. 20 is exploded perspective view of a third embodiment of the collapsible stirrer according to the present invention.

FIG. 20 shows another embodiment of the stirrer 130 described in the lid of FIGS. 18 and 19. The stirrer 130' is collapsed in four sections. Section 300 is disposed in a center core 320. The center core is attached through aperture 330 to the rotary connector 132. Stirrer section 302 is foldably connected at one end to section 300 and at the opposite end to a first end of stirrer section 304. The second end of stirrer 304 is foldably connected to a first end of section 306. Section 306 includes a paddle 308 opposite the first end of section 306. In operation, sections 302, 304, and 306 unfold upon rotation of the pivot handle 136, extending downward from the lid such that the paddle rotates near or at the bottom of a beverage container to which the lid 120 may be attached.

The mixing lid assembly according to the present invention provides an effective way for mixing ingredients in a beverage in a safe and convenient manner. Additionally, the integral arrangement of a lid and mixing device is seen to provide sanitary benefits, at least since a separate spoon, stir stick or other stirring device is not required. For example, the inventors have recognized that it is not always apparent what, if any, steps have been taken to keep such stirring devices clean prior to and between uses. In contrast, the mixing assembly 110 of the present invention provides an integrated assembly that may be separately packaged (e.g., wrapped in plastic prior to use) such that only the individual drinker or store personnel has access to the assembly prior to use.

With the mixing assembly in the stowed position, more efficient storage and shipment of the lid is possible. It is desirable to mix and stir beverages for an entire volume of the beverage container such that stirring devices are typically placed as close to a bottom surface of the beverage container as is practical. While it is within the scope of the present invention to provide individual, like sized (e.g., small, medium, large and extra large) mixing devices 130, the inventors has recognized that it may be particularly advantageous to have one mixing device 130 that adjusts (manually or automatically) to the varying sizes of beverage containers. In view thereof, in one embodiment the slideable engagement between the third arm 166 and the fourth arm 168 is such that a force is needed to overcome the frictional forces tending to hold the arms 166 and 168 together.

The rotary dial or rotary plate 20 is rotated (e.g., in at least one of a clockwise and counterclockwise direction) such that the rotary connector 28, pin and the mixer turn in the corresponding at least one clockwise or counterclockwise direction. When affixed to the beverage container 16, the rotational motion is sufficient for stirring or mixing the contents of the beverage container 16. As with the previous embodiment, the mixing device is selectively disposed between one of a released position and a stowed position. In the stowed position the mixer is folded into a "pancake position" to lay substantially flat against the inner surface of the lid. In one embodiment, a retaining clip is coupled to the pin. The retaining clip retains the stowed mixer in the pancake position for example, by contacting arms of the mixer. As can be appreciated, the retaining clip is advantageous in, for example, shipment and storage, for ensuring that the mixer is not inadvertently released from the pancake position. In one embodiment, the retaining clip rotates with the pin and after an initial about quarter turn (e.g., about 90° rotation) the retaining clip releases the mixer into the released position. It should be appreciated that while described above as including the retaining clip it is within the scope of the present invention to form a clip, hook, or like catching surface within an inner diameter of the lid for retaining the mixer in the pancake position until at least the rotary dial is first turned to activate the mixing device.

The mixer includes a plurality of telescoping arms. In one embodiment, the telescoping arms include a first arm coupled to and positioned substantially parallel to the rotary connector and the inner surface of the lid, a second arm rotatably coupled to the first arm and at least a third arm rotatably coupled to the second arm. It should be appreciated that the rotational movement of the second and third arms provide the aforementioned folding capability for achieving the stowed (e.g., the "pancake" position) and released positions. In one embodiment the telescoping arms further include a fourth arm slidably coupled to the third arm, and a fifth arm slidably coupled to the fourth arm. As described above, the fourth arm and fifth arm slide (by the aforementioned manual or "automatic" forces) relative to the third arm and fourth arm, respectively, such that the mixer achieves an adjustable depth when released within various sized beverage containers. The rotary dial includes a hole or depression in a surface of the dial such that a beverage drinker may use his/her finger or other implement (e.g., pen, pencil or the like) to rotate the dial. In one embodiment, a wall or ridge in the surface of the dial is formed in proximity to the hole or depression to assist rotation. In these ways, the present invention allows for the mixing of beverages in a safe, sanitary, effective and user-friendly manner.

Figure 21:
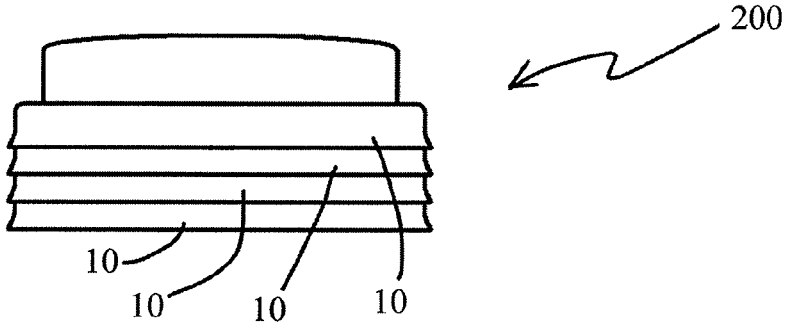
FIG. 21 is a side elevational view of a stack of lids according to the present invention.
Figure 22:
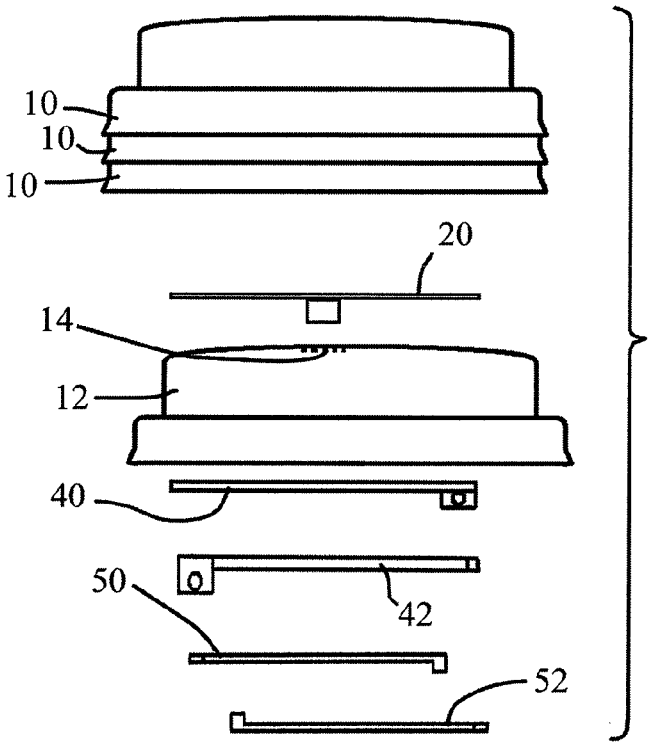
FIG. 22 is a side elevational view of the stack of lids shown in FIG. 21 with the bottom lid exploded.

FIGS. 21 and 22 show a stack 200 of mixing lids 10, each mixing lid including a lid 12 having a central opening 14 and a mixing assembly 8 rotatable about the central opening 14 of the lid 12. The mixing assembly 8 includes a rotary plate 20 disposed on an upper surface of the lid 12 and a rotary arm 40 disposed on a lower surface of the lid 12 and attached to the rotary plate 20 through the central opening 14 in the lid 12, the rotary arm 40 lying substantially flat against the lid 12 lower surface. The mixing assembly also includes a pivot arm 42 pivotably attached to a first end of the rotary arm 40, the pivot arm 42 is pivotable from a first position lying flat against the interior surface of the lid to a second downward position extending toward the bottom of a beverage container. The mixing assembly 8 includes a mixing arm 50 pivotably attached to a second end of the pivot arm 42 opposite the first end of the pivot arm. The mixing arm 50 is extendable along an adjacent mixing member 52. The mixing lids 10 include the rotary arm 40 and the mixing arm in a position lying flat against the lower lid surfaces such that the plurality of mixing lids forms a stack.

Thus, the present invention provides a lid with a collapsible stirrer. The stirrer of mixing assembly is releasable from a first position lying flat against the interior surface of the lid to a second downward position extending toward the bottom of the beverage container. After release, the stirrer is variably extendable whereby the contents at the bottom of various sized beverage containers may be reached.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A mixing lid attachable to a beverage container, comprising:

a lid base having an upper surface, a lower surface and a central opening extending between the upper and lower surfaces;

a mixing assembly rotatable about the central opening of the lid base, the mixing assembly including:

a rotary plate disposed on the upper surface of the lid base;

a rotary arm disposed on the lower surface of the lid base and attached to the rotary plate through the central opening in the lid, the rotary arm lying substantially flat against the lower surface of the lid;

a pivot arm pivotably attached at a first end of the pivot arm to the rotary arm, the pivot arm pivotable from a first position lying flat against the interior surface of the lid to a second downward position extending toward the bottom of the beverage container; and a mixing arm pivotably attached to a second end of the pivot arm opposite the first end of the pivot arm.

2. The mixing lid of claim 1 wherein the mixing arm comprises a plurality of mixing members each slidably attached along an adjacent mixing member.

3. The mixing lid of claim 1 including the mixing arm pivotable from a first position lying flat against the interior surface of the lid in the collapsed position to a second downward position extending toward the bottom of the beverage container and in the extended position.

4. The mixing lid of claim 1, the mixing arm including at least one mixing member extendable to the bottom of the beverage container.

5. The mixing lid of claim 1 including a second opening near an edge of the lid for removing the beverage in the beverage container.

6. The mixing lid of claim 1, wherein the mixing assembly is foldable for positioning between a first stowed position wherein the mixing assembly lies substantially flat against an inner surface of the lid and a second released position wherein the mixing arm extends to a depth of the beverage container.

7. The mixing lid of claim 1 including an annular lip for sealably attaching the lid to the beverage container.

8. The mixing lid of claim 1 wherein the rotary plate includes a receptacle adapted to accept a finger or object for producing a rotational force on the rotary plate.

9. The mixing lid of claim 1 including a fixed tab disposed near the lower surface of the lid positioned to hold the second rotary arm and the telescoping mixing against the lid lower surface when the mixing assembly is in a first position and to release the second rotary arm and the telescoping mixing arm when the mixing assembly is rotated away from the first position.

10. The mixing lid of claim 1 wherein the mixing assembly includes a hub disposed in the central opening connecting the rotary plate to the rotary arm.

11. A stack of mixing lids, each mixing lid including a lid having a central opening;

a mixing assembly rotatable about the central opening of the lid, the mixing assembly including:

a rotary plate disposed on an upper surface of the lid;

a rotary arm disposed on a lower surface of the lid and attached to the rotary plate through the central opening in the lid, the rotary arm lying substantially flat against the lid lower surface;

a pivot arm pivotably attached to a first end of the rotary arm, the pivot arm pivotable from a first position lying flat against the interior surface of the lid to a second downward position extending toward the bottom of the beverage container; and a mixing arm pivotably attached to a second end of the pivot arm opposite the first end of the pivot arm, the mixing arm extendable along an adjacent mixing member;

whereby the mixing lids include the rotary arm and the mixing arm in a position lying flat against the lower lid surfaces such that the plurality of mixing lids forms a stack.

* * * * *